US010682546B2

(12) United States Patent
Dubin et al.

(10) Patent No.: US 10,682,546 B2
(45) Date of Patent: Jun. 16, 2020

(54) PROPER ROWING TECHNIQUE

(71) Applicant: David P. Dubin, Holliston, MA (US)

(72) Inventors: David P. Dubin, Holliston, MA (US); Robert F. Rioux, Ashland, MA (US)

(73) Assignee: David P. Dubin, Holliston, MA (US)

( * ) Notice: Subject to any disclaimer, the term of this patent is extended or adjusted under 35 U.S.C. 154(b) by 57 days.

(21) Appl. No.: 16/104,306

(22) Filed: Aug. 17, 2018

(65) Prior Publication Data

US 2019/0192899 A1 Jun. 27, 2019

Related U.S. Application Data

(60) Provisional application No. 62/608,684, filed on Dec. 21, 2017.

(51) Int. Cl.
*A63B 22/00* (2006.01)
*A63B 21/00* (2006.01)
(Continued)

(52) U.S. Cl.
CPC ..... *A63B 22/0046* (2013.01); *A63B 21/153* (2013.01); *A63B 22/0076* (2013.01);
(Continued)

(58) Field of Classification Search
CPC ..... A63B 21/00058; A63B 21/00069; A63B 21/00072; A63B 21/00076; A63B 21/00185; A63B 21/012; A63B 21/0125; A63B 21/018; A63B 21/15; A63B 21/151; A63B 21/153; A63B 21/159; A63B 21/16; A63B 21/22; A63B 21/225; A63B 21/227; A63B 21/4027; A63B 21/4029; A63B 21/4031; A63B 21/4033; A63B 21/4034; A63B 21/4035; A63B 21/4039; A63B 21/4041; A63B 21/4045; A63B 21/4047; A63B 21/4049; A63B 22/0046; A63B 22/0076; A63B 22/0087; A63B 21/0089; A63B 2022/0079; A63B 69/0057; A63B 69/0059; A63B 69/06; A63B 2069/062; A63B 2069/068; A63B 71/0054; A63B 2071/0063; A63B 2071/0072; A63B 2071/0081; A63B 2071/009;
(Continued)

(56) References Cited

U.S. PATENT DOCUMENTS 1,974,445 A * 9/1934 Calleson ..... A63B 22/0076 482/72
2,251,120 A * 7/1941 Davis ..... A63B 22/0076 482/73
(Continued)

OTHER PUBLICATIONS

"WaterRower A1 Owner's Manual", 1988, WaterRower Inc. (560 Metacom Ave., Warren, RI 02885, 800-852-2210), <www.waterrowerservice.com/manuals> (28 Pages).
(Continued)

*Primary Examiner* — Gary D Urbiel Goldner

(57) ABSTRACT

The present invention relates to systems and devices for improving of a rower's technique. In particular, the invention provides one or more clamps that can be used in conjunction with a rowing machine to provide external cues that the rower can use to monitor and correct his or her catch technique without the assistance of a coach or other person.

15 Claims, 21 Drawing Sheets

(51) Int. Cl.
*A63B 71/00* (2006.01)
*A63B 69/00* (2006.01)
*A63B 69/06* (2006.01)

(52) U.S. Cl.
CPC ..... *A63B 69/0057* (2013.01); *A63B 71/0054* (2013.01); *A63B 2022/0079* (2013.01); *A63B 2069/068* (2013.01); *A63B 2071/0072* (2013.01)

(58) Field of Classification Search
CPC .... A63B 2208/0228; A63B 2208/0233; A63B 2208/0238; A63B 2210/00; A63B 2210/50; A63B 2225/09; A63B 2225/093
See application file for complete search history.

(56) References Cited

U.S. PATENT DOCUMENTS 3,346,256 A * 10/1967 White ..... A63B 21/0783 482/94
4,396,188 A 8/1983 Dreissigacker et al.
4,705,268 A * 11/1987 Nadeau ..... A63B 22/0076 446/397
4,743,011 A * 5/1988 Coffey ..... A63B 21/0088 482/111
4,875,674 A 10/1989 Dreissigacker et al.
5,007,632 A * 4/1991 Wilkinson ..... A63B 21/04 482/130
5,370,593 A * 12/1994 Wang ..... A63B 21/0083 482/51
5,707,322 A * 1/1998 Dreissigacker ..... A63B 21/227 482/72
6,371,892 B1 * 4/2002 Dreissigacker ..... A63B 21/227 482/72
6,682,462 B1 * 1/2004 Lee ..... A63B 21/0552 482/62
7,201,708 B2 4/2007 Dreissigacker et al.
9,028,374 B1 * 5/2015 Brady ..... A63B 22/0076 482/72
2005/0085348 A1 * 4/2005 Kiefer ..... A63B 22/0076 482/72
2008/0302293 A1 * 12/2008 Nesseth ..... B63H 16/105 114/363
2016/0375297 A1 * 12/2016 Kiser ..... A63B 22/0076 482/73
2018/0126216 A1 * 5/2018 Hamilton ..... A63B 22/0076

OTHER PUBLICATIONS

"WaterRower M1 Owner's Manual", 2004, WaterRower Inc. (560 Metacom Ave., Warren, RI 02885, 800-852-2210), <www.waterrowerservice.com/manuals> (28 Pages).
"WaterRower S3 Assembly Manual", 2004, WaterRower Inc. (560 Metacom Ave., Warren, RI 02885, 800-852-2210), <www.waterrowerservice.com/manuals> (5 Pages).
"WaterRower S3 Owner's Manual", 2004, WaterRower Inc. (560 Metacom Ave., Warren, RI 02885, 800-852-2210), <www.waterrowerservice.com/manuals> (18 Pages).
"WaterRower S4 Owner's Manual", 2004, WaterRower Inc. (560 Metacom Ave., Warren, RI 02885, 800-852-2210), <www.waterrowerservice.com/manuals> (28 Pages).
"Concept 2 Indoor Rower Training Guide", 2018, Concept2 Inc. (8 Pages).
"How to Use the Indoor Rower", 2018, Concept2 Inc. (1 Page).
"Models D&E Indoor Rower Parts List", 2018, Concept2 Inc. (1 Pages).
"Concept 2 Indoor Rower Brochure", 2018, Concept2 Inc. (12 Pages).
"The Concept2 Slide", 2018, Concept2 Inc. (2 Pages).

* cited by examiner

FIG. 20
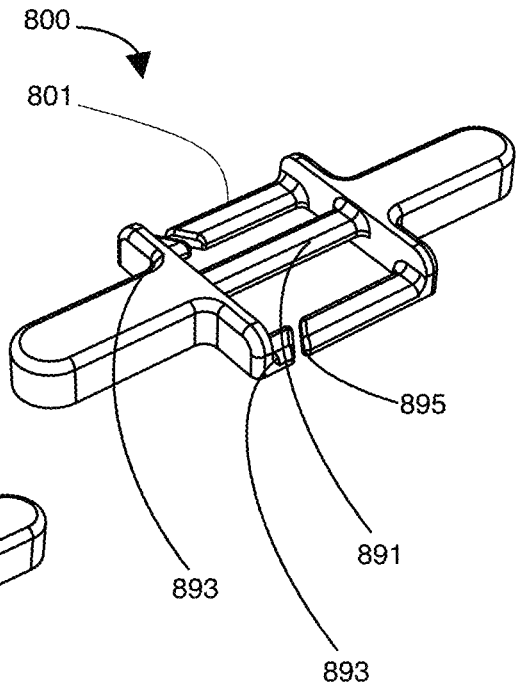
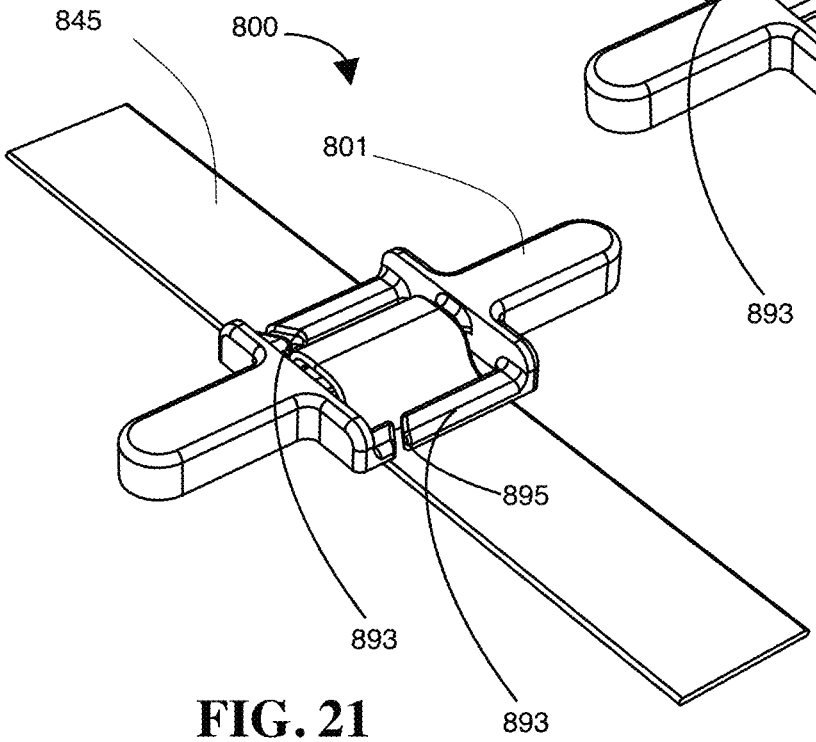
FIG. 21

PROPER ROWING TECHNIQUE

CROSS REFERENCE TO RELATED APPLICATIONS

This application claims priority to and the benefit of U.S. Provisional Patent Application No. 62/608,684 filed Dec. 21, 2017, the entirety of which is incorporated herein by reference.

TECHNICAL FIELD

The present invention relates to rowing machines used by people for exercise and/or training.

BACKGROUND

Rowing machines are commonly used to simulate the action of watercraft rowing for the purpose of exercise and/or training. A rower simulates this action by pulling a chain, or strap, from a resistance device connected to a standing frame. This movement causes a sliding seat and footrests attached to the standing frame to move farther and closer apart as the rower executes a stroke, which consists of the catch, the drive, the release, and the recovery.

Just like any form of exercise, improper form or technique causes inefficiency and, in some cases, serious injury. The risk of injury is particularly prominent while rowing because rowing is often performed at high intensity and requires precise and subtle technique. The most common injury in rowing is to the person's lower back due to poor catch positioning.

If a person is not taught to row with proper form, the biggest error the person can make is sliding the seat too close to his or her feet while in the catch. This position places the rower's back and knees in a compromised position and compresses their back, which over time causes injury. Moreover, even if taught properly, this poor positioning can happen to a rower once the rower is fatigued by a workout.

Because proper rowing technique is so precise and subtle, it is difficult for the rower to detect his or her own deviations from proper form. The best way to prevent injuries arising from poor form while a person is exercising and/or training on a rowing machine is for another person (such as a coach or personal trainer) to observe the rower's technique and constantly assist the rower by fixing the rower's bad positioning. However, a coach usually cannot constantly monitor an individual rower, especially when there are multiple rowers to observe and help in a given class, and thus rowers continue to suffer from injuries caused by poor form.

SUMMARY OF THE INVENTION

The invention provides systems and devices that help a person execute proper technique while rowing on a rowing machine by providing external cues that the person can visualize and/or feel regarding their form throughout a training session. These systems and devices serve to encourage proper technique and inhibit poor technique, such as over compressing in the catch, by providing a stopper to softly halt the rowing seat and/or chain handle from going beyond the rower's proper range of motion, all without the need for or help from a coach or other person observing the rower.

In one example, systems and devices according to the invention relate to one or more clamps attachable to a conventional rowing machine to ensure that the rower uses proper catch technique. One example of a conventional rowing machine is available from Concept 2, Inc. of Vermont, which is the current "standard" within the rowing community. Using one or more clamps according to the invention in connection with such a rowing machine improves a rower's technique by guiding the rower where to begin and return to on each stroke.

Poor catch technique refers to a rower over compressing and allowing the seat to slide too far forward. Over compressing causes strain in the lower back by putting too much pressure on the rower's spine, which ultimately leads to injury. The one or more clamps prevent this injury by ensuring the rower's seat is kept behind their shoulders, and that the rower does not lean too far forward, while in the catch. The one or more clamps achieve this by providing a stopper to prevent the rowing seat and/or chain handle from moving beyond a specified distance at the front of the rower and beyond the rower's optimal range of motion.

In one aspect, the invention relates to a system comprising a rowing machine with a generally horizontal frame having a front portion and a rear portion, the front portion and the rear portions separated by a center beam. The rowing machine includes a seat movably attached to the center beam such that the seat can move in a longitudinal direction along the center beam relative to the horizontal frame for at least a limited distance. A resistance device is associated with the horizontal frame and comprises a drive chain with two ends. A first end is connected to the resistance device and a second end includes a handle such that when the handle is pulled by the rower, the rower is met with resistance. The system further includes a beam clamp that is detachably disposed on the center beam and arranged between the front portion of the rowing machine and the seat. The beam clamp prevents the seat from moving beyond a specified distance towards the front portion of the machine as the seat slides along the center beam. The specified distance is determined such that the rower's seat kept behind the rower's shoulders, relative to the front portion of the rowing machine, when the rower is in the catch.

In certain embodiments the system comprises a beam clamp with a body having an interior formed by a top piece, a bottom piece, and at least one fastener for securing the top piece to the bottom piece. Preferably, the beam clamp is strong and durable and configured such that the beam clamp can be quickly clamped onto a center beam and removed therefrom. Moreover, the beam clamp should be adjustable for different sizes of center beams, and provide a mechanism for securing its placement along the center beam such that it cannot be moved once in place.

In some embodiments, an interior surface of the beam clamp comprises inwardly curved portions for fastening to a circular center beam. Alternatively, the beam clamp may be adapted for fastening to center beams having various extensions.

In other embodiments, the system comprises a rowing machine with a generally horizontal frame having a front portion and a rear portion, the front portion and the rear portions separated by a center beam. The rowing machine includes a seat movably attached to the center beam such that the seat can move in a longitudinal direction along the center beam relative to the horizontal frame for at least a limited distance. A resistance device is associated with the horizontal frame and comprises a drive chain with two ends. A first end is connected to the resistance device and a second end includes a handle such that when the handle is pulled by the rower, the rower is met with resistance, and a chain clamp. The chain clamp is configured to fasten onto a drive chain of the rowing machine so as to prevent a chain handle from going too far towards the front portion of the rower and beyond the rower's optimal range of motion.

The chain clamp provided by some embodiments of the invention shortens the rower's range of motion by operating as a stopper as the drive chain is fed back into a resistance device when the rower leans forward to begin a new stroke. More particularly, as a rower leans forward on a rowing machine, the resistance device pulls the drive chain back towards the device. When the drive chain is pulled, the drive chain passes through an aperture pass too narrow for the chain clamp to pass through. By positioning the chain clamp on a side of the aperture opposite the resistance device, the chain clamp stops the movement of the drive chain as the rower leans forward. The association of the chain clamp and aperture together provide an external cue to show how far the rower should lean in towards a front portion of the rowing machine at the catch.

In other embodiments, the system comprises a rowing machine with a generally horizontal frame having a front portion separated from a rear portion by a center beam. A seat movably attached to the center beam such that the seat is movable in a longitudinal direction along the center beam relative to the generally horizontal frame for at least a limited distance. A resistance device is associated with the horizontal frame and comprises a drive chain with two ends. A first end is connected to the resistance device and a second end includes a handle such that when the handle is pulled by the rower, the rower is met with resistance. The system further including an "L" shaped back support clamp, or L-clamp, attached to a rear portion of the seat. The L-shaped clamp comprising a generally curved, elongated body a first end connected to a rear portion of the seat and a second end comprising a contact indicator, wherein the contact indicator provides the rower information relating to a position of the rower's back position. The L-clamp providing a reference point that a rower can use to know when and how far he or she should lean in during a stroke.

In another aspect, the invention relates to a clamp having a body formed by a top piece, a bottom piece, and at least one fastener for securing the top piece to the bottom piece. The clamp has an interior surface for enclosing a circumference of a center beam of a rowing machine. By attaching to the center beam of the rowing machine, the clamp can prevent a movable seat in association with the center beam from moving beyond a certain distance towards a front portion of the rowing machine.

The above-mentioned clamp can be used individually or with one or more other such clamps.

BRIEF DESCRIPTION OF THE DRAWINGS

The various aspects, embodiments, features, and advantages of the invention will be apparent from the description that follows this brief description of the drawings, and it is noted that the description is meant to be exemplary and not limiting on the invention.

FIG. 20 shows an embodiment of a chain clamp.

FIG. 21 shows an embodiment of a chain clamp fastened to a strap.

DESCRIPTION

The invention relates to systems and devices to ensure proper rowing technique by providing external cues that a rower can visualize and/or feel to monitor and correct their form while rowing, without the need for a coach or any other person providing feedback on how the rower is performing on a rowing machine. The external cues provide the rower with immediate and constant feedback, which enable the rower to improve his or her rowing technique. This is advantageous since rowing requires precise technique that is difficult for the rower to monitor on his or her own. Rowing with incorrect technique is inefficient and also can result in injury. The most common injuries related to poor rowing technique are lower back injuries. This is often a result of over compression in the catch, wherein the rower's seat comes too far forward on the rowing machine placing unnecessary strain on the rower's knees and lower back.

Figure 1:
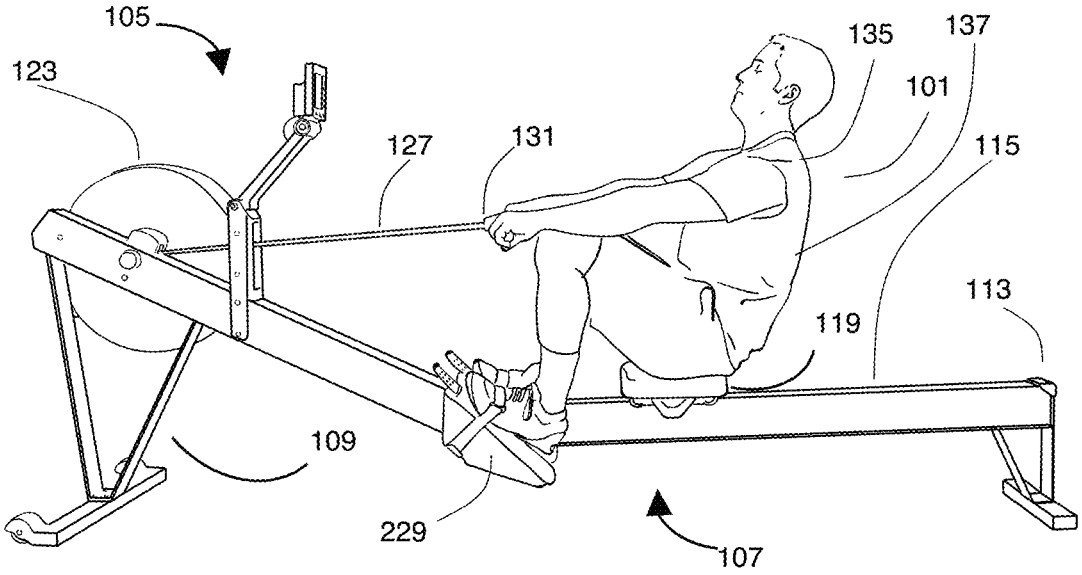
FIG. 1 illustrates a rower using poor catch technique on a conventional rowing machine.

FIG. 1 illustrates a rower 101 on a conventional rowing machine 105. The conventional rowing machine 105 is one that has a generally horizontal frame 107 with a front portion 109 and a rear portion 113, where the front portion 109 and the rear portions 113 are separated by a center beam 115. The rowing machine 105 also has a seat 119 movably attached to the center beam 115 such that the seat 119 can move in a longitudinal direction along the center beam 115 relative to the horizontal frame 107 for at least a limited distance. A resistance device 123 is associated with the horizontal frame 107 and comprises a drive chain 127 with two ends. A first end is connected to the resistance device 123 and a second end includes a handle 131 such that, when the handle 131 is pulled by the rower 101, the rower 101 is met with resistance from the resistance device 123. One example of a conventional rowing machine is available from Concept 2, Inc. of Vermont, and it currently is the standard within the rowing community for rowing exercise and/or training. The rowing machine 105 is described in U.S. Pat. Nos. 4,396,188, 4,875,674, and 7,201,708, and it is referenced throughout this specification. However, this machine is merely one example of a rowing machine that may be used on conjunction with the present invention. The invention may be employed in connection with other rowing machines, whether now known and available or later introduced. Also, the invention could be incorporated into and/or sold with any rowing machine, as opposed to being an after-market component for use with a rowing machine.

In operation, a rower 101 sits on a movable seat 119 with his or her feet in foot straps 229 and holds an end of the drive chain 127 comprising a handle 131. The rower "rows" on the rowing machine 105 while sliding the seat 119 and pulling the handle 131.

Poor catch technique, demonstrated in FIG. 1, relates to a rower 101 bringing his or her seat 119 too close to a front portion 109 of a rowing machine 105. This position places strain on the rower's lower back 137, which over time leads to serious injury. Conversely, in proper catch form, a rower's shoulders 135 should be in front of the rower's seat 119, relative to a front portion 109 of a rowing machine 105.

Providing individualized feedback to a rower 101 on each stroke is generally not practical. Moreover, it is difficult for the rower 101 to determine on his or her own the spatial relationship of his or her seat 119 relative to his or her hands and lower back 137. As such, the systems and devices of the present invention are a significant advancement in the field, providing one or more clamps which can be used in conjunction with a rowing machine to ensure that a rower 101 uses proper catch technique, thereby training the rower 101 to row efficiently while preventing injury.

Figure 2:
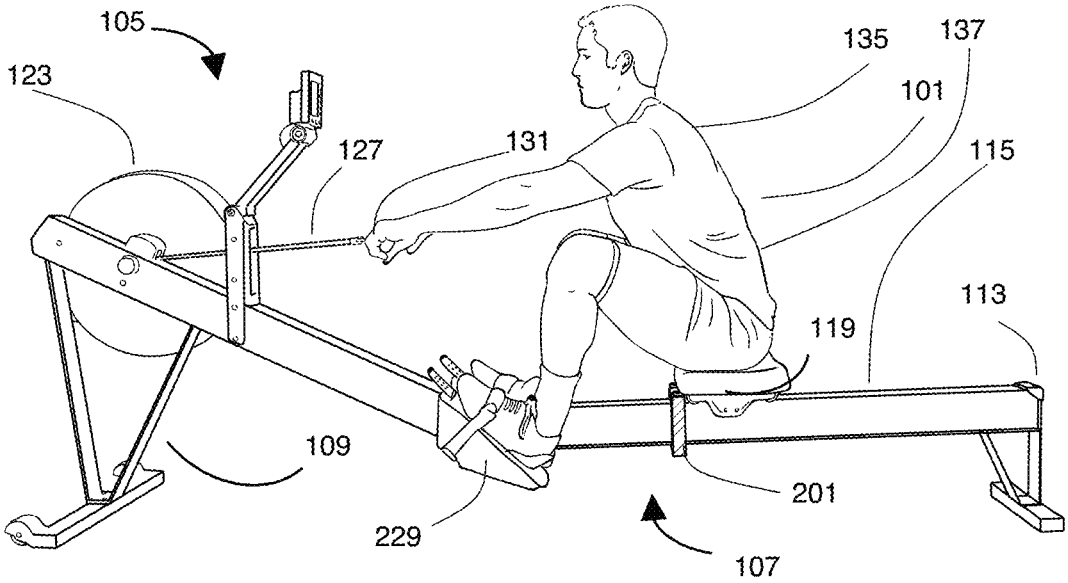
FIG. 2 illustrates a rowing machine with a beam clamp attached ensuring the rower executes proper catch technique.

FIG. 2 shows an embodiment of the invention wherein a beam clamp 201 is attached to a center beam 115 of a rowing machine 105. Generally, a seat 119 of a rowing machine slides along a track of a center beam 115, or rolls along the center beam 119 on a carriage, during use. In the embodiment shown in FIG. 2, the beam clamp 201 obstructs the track and precludes the seat 119 from sliding beyond a certain distance forward on the center beam 115.

Placement of the beam clamp 201 determines how far forward the seat 119 can move along the center beam 115 and can be determined by a rower based on the rower's 101 optimal range of motion. Preferably, the beam clamp 201 is placed such that when a rower 101 is in the catch position, as shown in FIG. 2, the rower's seat 119 is positioned behind the rower's shoulders 135, relative to the front portion 109 of the machine 105. This helps the rower 101 execute proper catch technique while rowing by stopping the seat 119 from sliding too far forward at the beginning of each stroke. This in turn keeps reduces the strain on the rower's lower back 137, thereby reducing incidence of injury.

Figure 3:
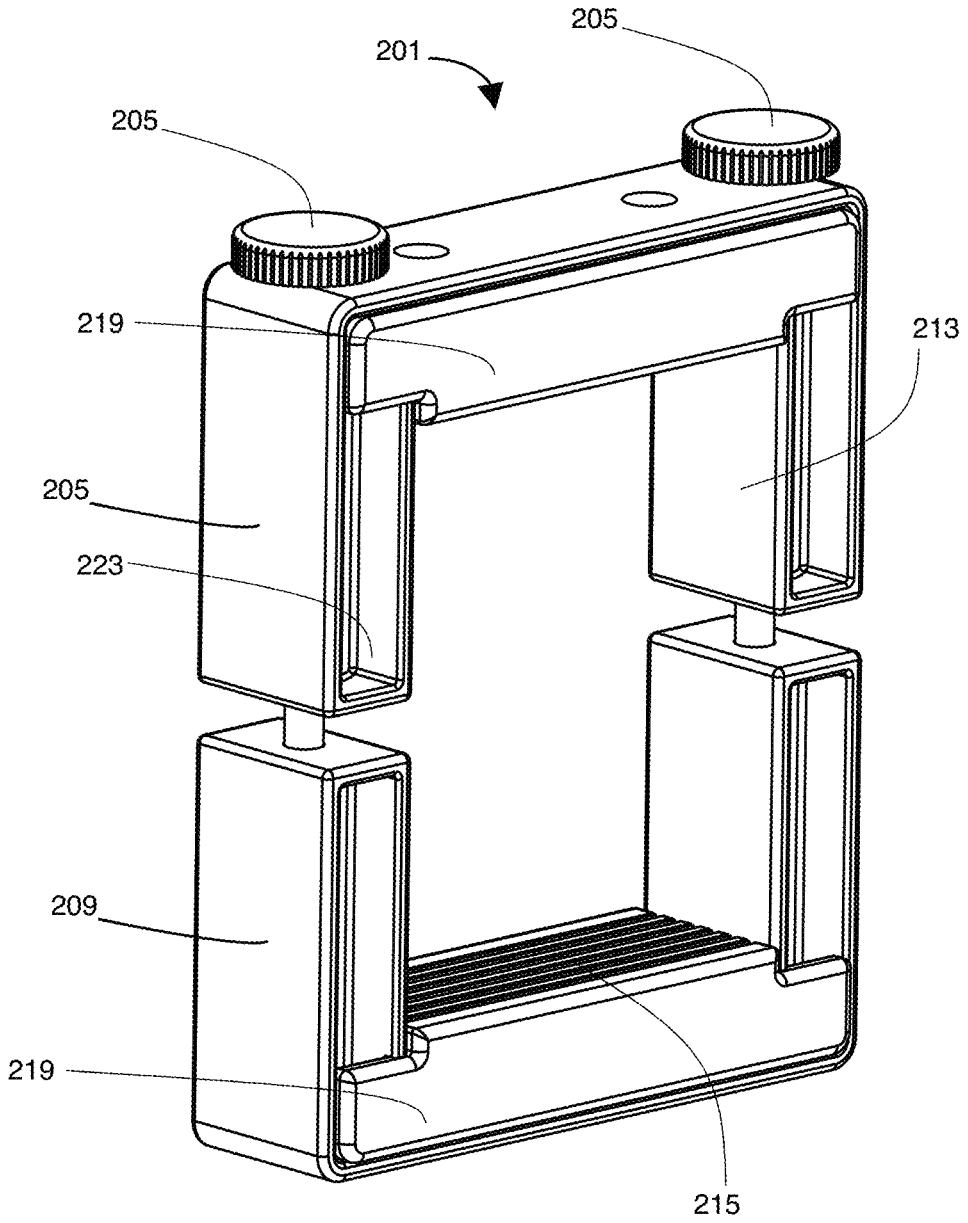
FIG. 3 is a 3D-side view of an embodiment of the beam clamp in a tightened position.

FIG. 3 shows a 3D drawing of a beam clamp 201 according to a preferred embodiment. The beam clamp 201 comprises a body formed by a top piece 205, a bottom piece 209, and at least one fastener 211 for securing the top piece 205 to the bottom piece 209. Alternatively, the top piece 205 and bottom piece 209 are fastened by other means, such as, for example, magnets, clips, or an adhesive. In the embodiment presented by FIG. 3, the at least one fastener 211 is configured to penetrate through the top piece 205 into the bottom piece 209, fastening the two pieces together. The beam clamp 201 further comprises an interior surface 213 configured such that the beam clamp 201 can embrace, or fasten around, a circumference of a center beam 115 of a rowing machine 105. Preferably, at least a portion of the interior surface 213 of the beam clamp 201 comprises a nonslip material 215, such as a rubber, to prevent the beam clamp 201 from sliding during use. In certain embodiments the beam clamp 201 has a surface dampener 219 disposed on at least a portion of an outer side 223 of the beam clamp 201. The surface dampener 219 allows the seat 119 to hit the clamp 201 without any damage occurring to the clamp or to rower seat 119. The surface damper 219 also softens the contact between the seat 119 and the beam clamp 201 as the beam clamp strikes the seat 119 during use providing a better user experience.

The beam clamp 201 can be manufactured from a variety of materials including but not necessarily limited to one or more plastics, metals, alloys, or any other suitable material (s). The beam clamp should be dimensioned for fitting onto a center beam of a rowing machine. The beam clamp 201 can be formed of plastic by an injection molding process, for example.

Figure 4:
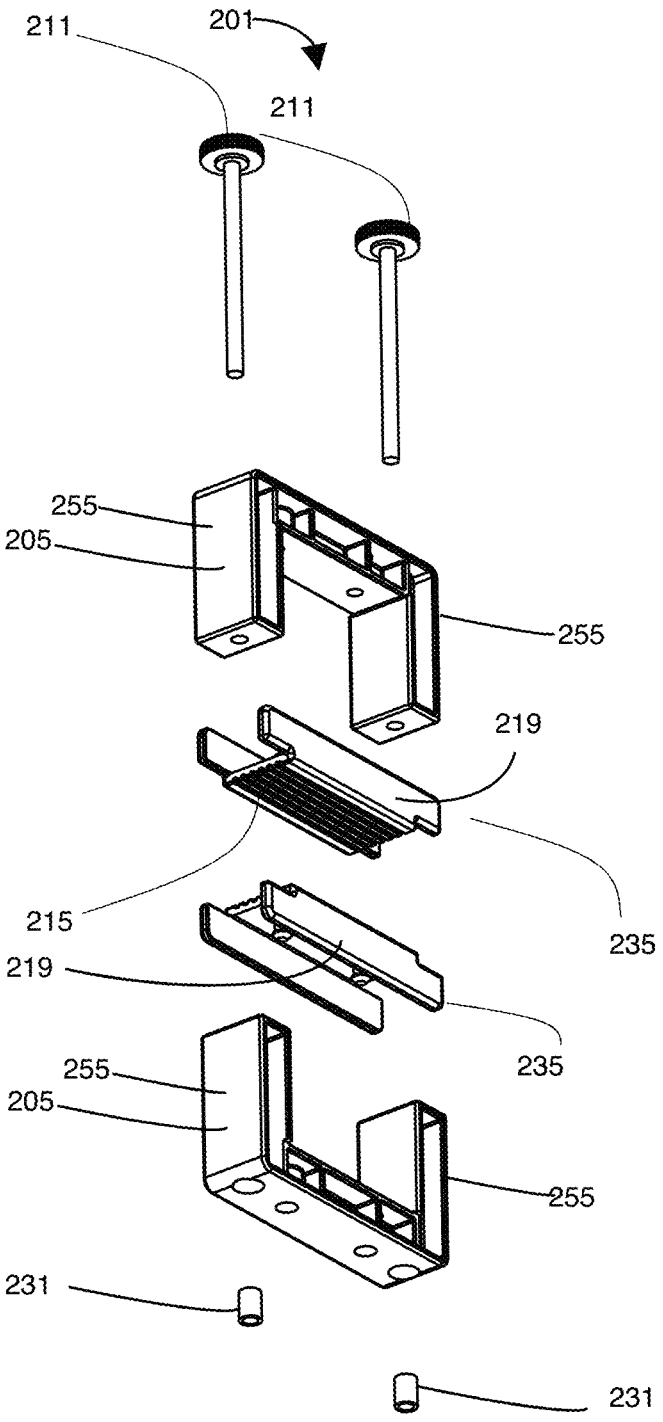
FIG. 4 is an exploded illustration of a beam clamp showing the parts that comprise the clamp according to one embodiment.

FIG. 4 is an exploded view of a beam clamp 201 according to an embodiment depicting parts of the clamp 201 and how those parts can be connected together. Preferably, a top piece 205 and a bottom piece 209 are secured together by at least one fastener 211. The two fasteners 211 can be designed to be tightened and loosened by a hand of a person such as the rower himself or herself. However, a variety of different types of fastener could be used. The fasteners 211 penetrate down through at least one side 255 of a top 205 and into a bottom 209 piece of a beam clamp 201 where the fasteners are met by securing members 231, such as, for example, nuts, which operate together with the fasteners 211 to tighten the top 205 and bottom pieces 209 together.

The top piece 205 and bottom pieces 209 are preferably U-shaped, and when joined together form a body having an interior surface 213 for fastening around a circumference of a center beam 115. In preferred embodiments, the interior surface 213 of the beam clamp 201 will comprise at least one nonslip surface 215, such as a rubber material, for preventing movement of the beam clamp 201 once fastened to a center beam 115 by way of friction. This enables a beam clamp 201 to remain in a stable position when tightened for use. In some embodiments, the beam clamp 201 includes pads 235 which comprise nonslip surfaces 215 and surface dampeners 235, the pads 235 configured to clip onto interior surfaces 213 of top 205 and bottom 209 pieces by prong fasteners 239. The surface dampeners 219 operate to soften the impact of the contact with a seat 119 of a rowing machine during use.

Figure 5:
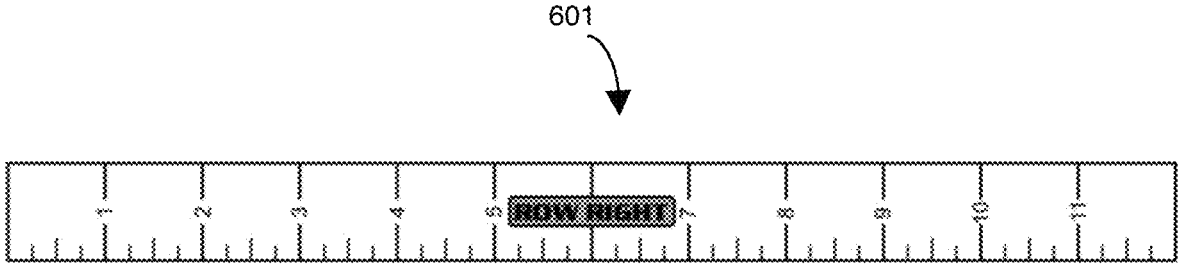
FIG. 5 shows decal measuring tape according to one embodiment of the invention.

FIG. 5 illustrates a decal measuring tape 601, which can be used in combination with systems of the present invention. The tape 601 is placed down a center of a center beam 201 of a rowing machine 105 and is used as a point of reference to set a beam clamp 201 according to an individual's custom positioning. Once a rower 101 determines where to place the beam clamp 201 during their first session using this system, they will be able to easily line the beam clamp 201 on the rowing machine 105 during every rowing session thereafter. This in turn minimizes the amount of time needed to determine beam clamp 201 placement prior to a workout. The beam tape 601 is preferably a thin plastic decal material with an adhesive surface. The tape 601 can have any number of dimensions. The dimensions of the tape 601 could, for instance be as follows: 12 inches in length 1¼ in in width Measurement markers made every ½ inch.

In some embodiments of the invention a rower 101 attaches a beam clamp 201 to a rowing machine 105 by completely loosening at least one fastener 211 on an end of the clamp 201. The fasteners 211, in some embodiments, penetrate completely through a top piece 205 of a beam clamp and into a bottom piece 209 along its sides 255. And as such, loosening both fasteners 211 completely separates the bottom 209 and top pieces 209 of the beam clamp 201 so that the beam clamp 201 can be attached onto a center beam 115 of a rowing machine 105.

Figure 6:
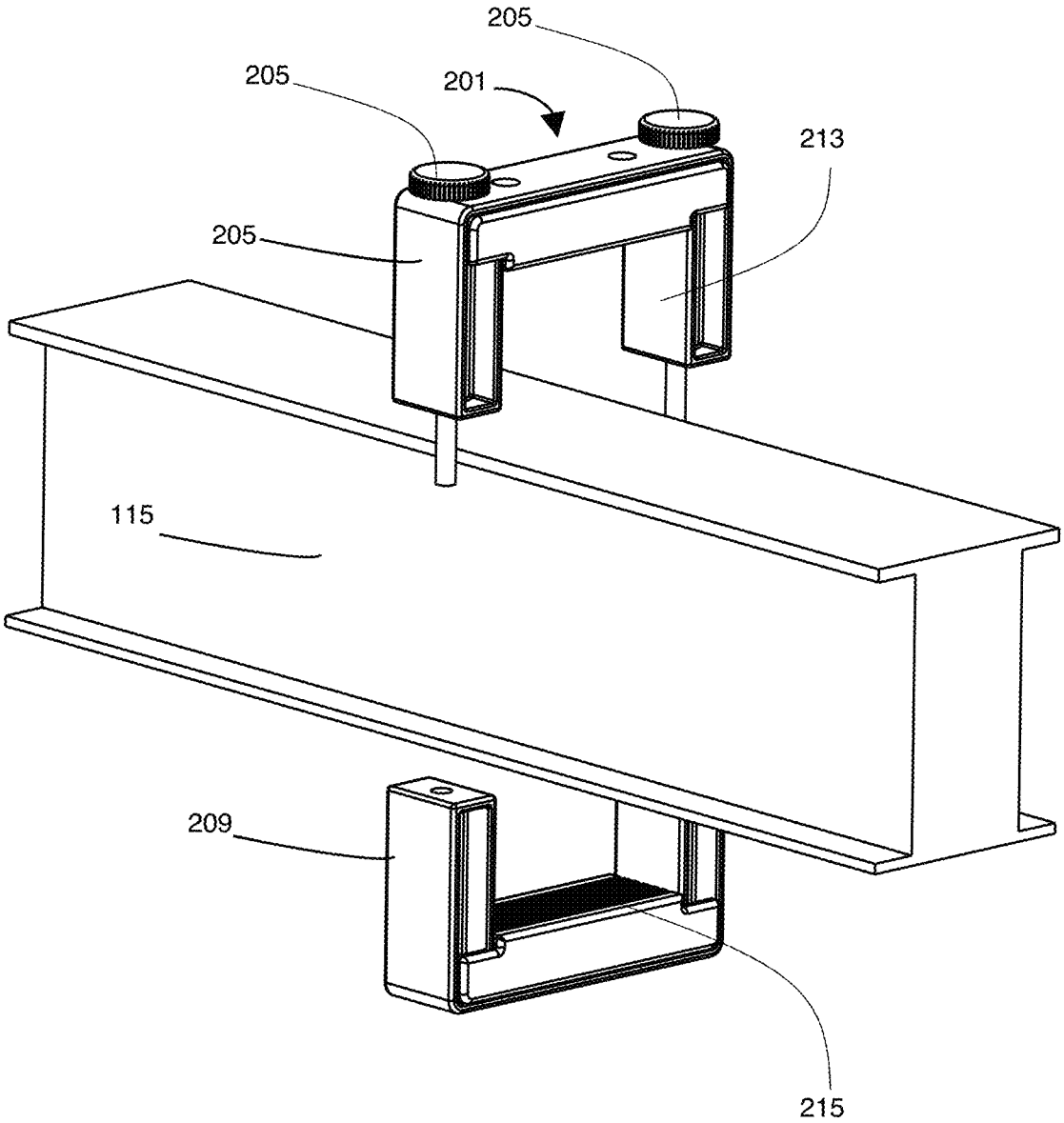
FIG. 6 illustrates the beam clamp with separated top and bottom pieces in preparation for its attachment to a center beam.

FIG. 6 illustrates a beam clamp 201 with separated top 205 and bottom pieces 209. To attach the beam clamp 201 to a center beam 115, a rower 101 first places a top piece 205 of the beam clamp 201 in the desired location of the center beam 115. This desired location is where the rowing seat 119 will be stopped according to the rower's limit to range of motion while rowing. Once the desired location is found, the rower 101 places the top piece 205 of the beam clamp 201 onto the center beam 115. Next, the rower 101 inserts the fasteners 211 through their respective holes on the top 205 of the beam clamp 201 so they pass through and insert into the bottom piece 209 of the clamp 201 which is placed directly underneath the top 205. The rower 101 then fully tightens the fasteners 211 so the clamp 201 remains in place throughout use.

Figure 7:
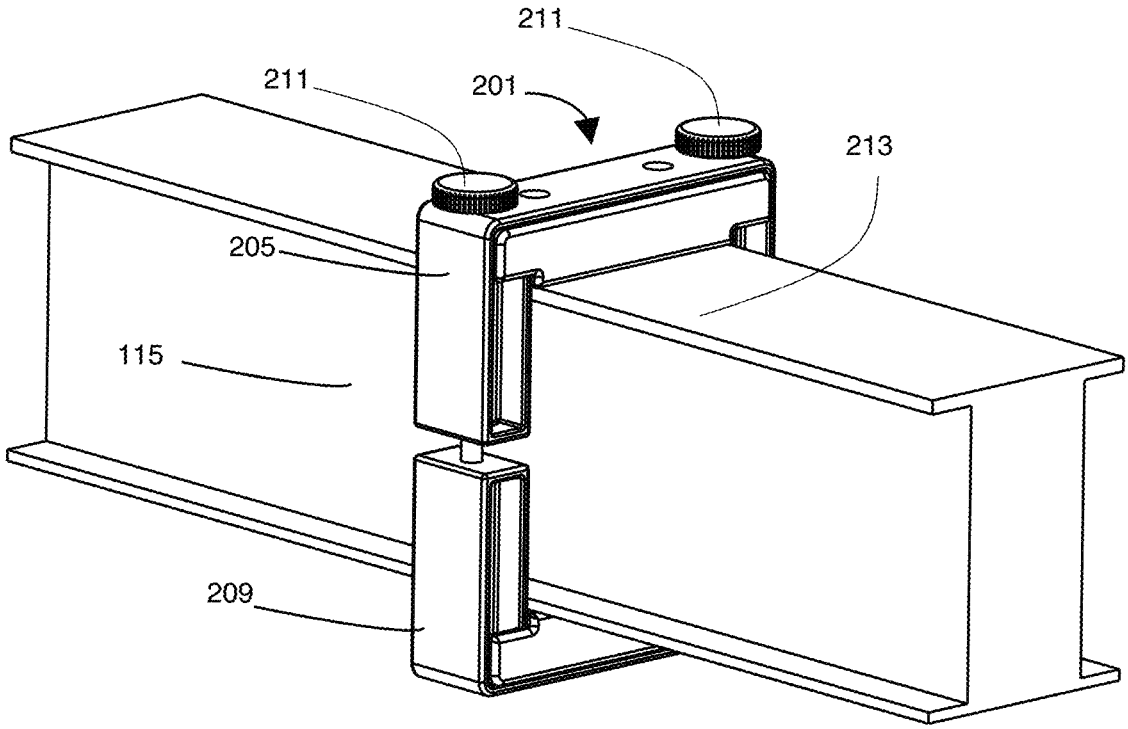
FIG. 7 shows a 3D-side view an embodiment of the beam clamp attached to a center beam.

FIG. 7 shows a beam clamp 201 fully fastened to a portion of a center beam 115 according to an embodiment of the invention. Once the fasteners 211 of the beam clamp 201 are tightened, the beam clamp 201 is in a stable position for use.

In some instances, it might be desirable for a rower to adjust a location of a beam clamp 201 along a center beam 115 during or after use. To move the beam clamp 201 along the center beam 115, according to some embodiments, the rower 101 simply loosens the fasteners 211. By lightly loosening the fasteners 211 the top 205 and bottom pieces 209 become partially separated allowing the beam clamp 201 to move up and down the center beam 201 according to the rower's changes in range of motion or for different users.

Figure 8:
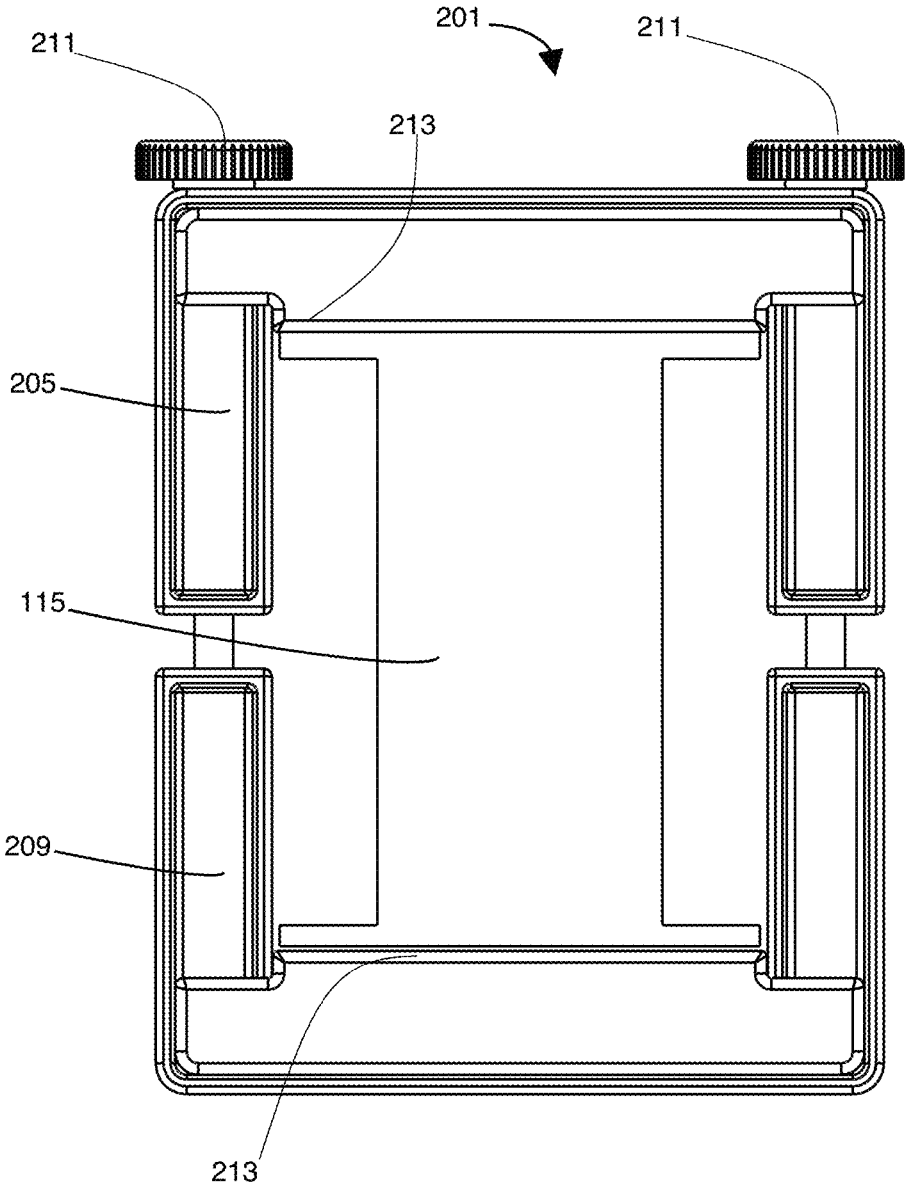
FIG. 8 is a longitudinal view showing a beam clamp fully tightened around a cross-section of a center beam.

FIG. 8 is a cross-sectional view of a center beam 115 showing a side of a beam clamp 201, according to an embodiment of the invention. In this embodiment, the beam clamp 201 is fully tightened around a circumference of the center beam 115. Nonslip surfaces 213, such as a rubber, tightly seal to the beam clamp 201 to the center beam 115 and create a steady hold onto the center beam 115 to eliminate movement.

Figure 9:
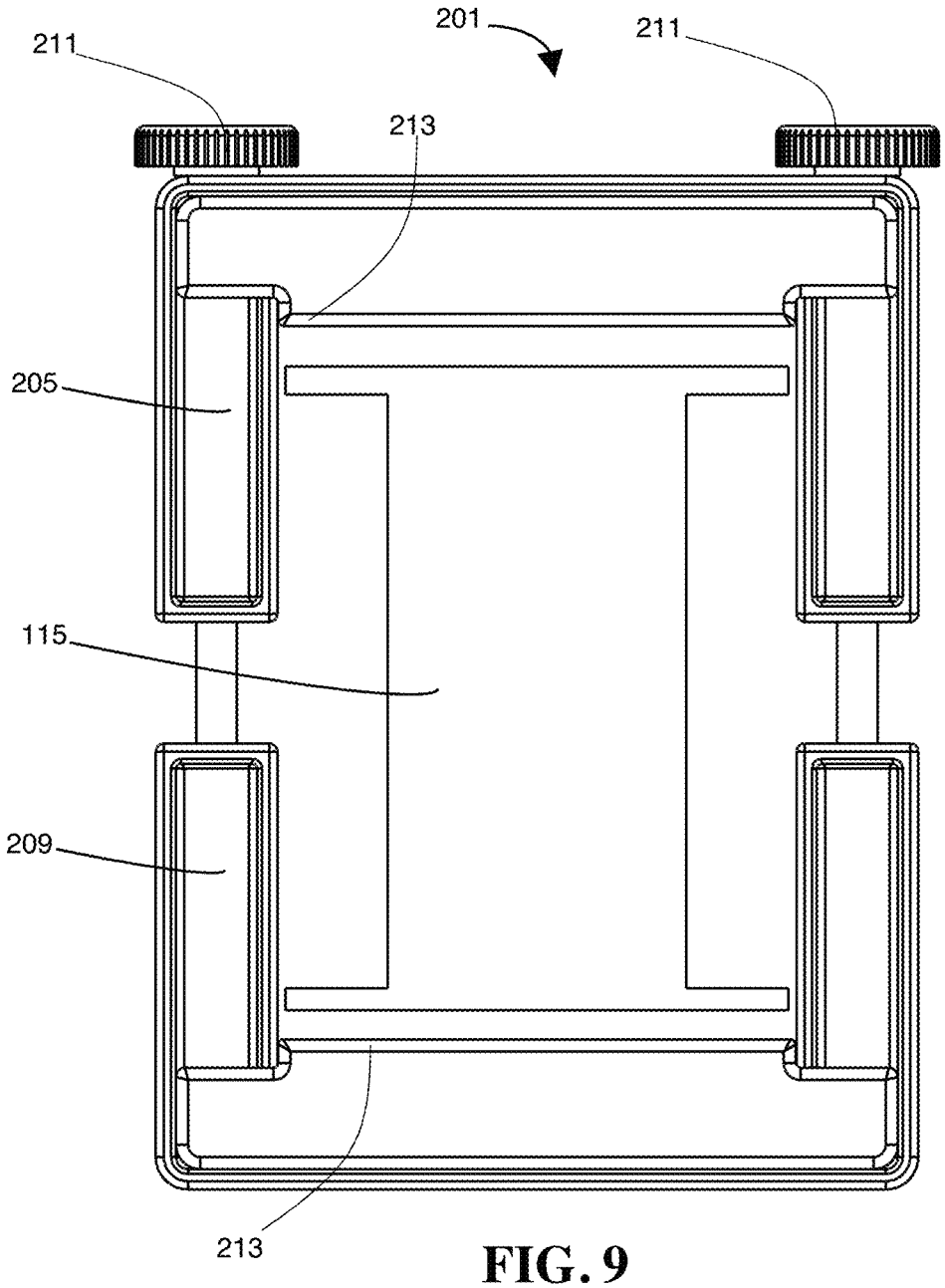
FIG. 9 is a longitudinal view showing a beam clamp in a loosened position around a center beam.

In contrast, FIG. 9 shows a cross-sectional view of a center beam 115 showing a side view of a beam clamp 201, the beam clamp 201 in a loosened position around the center beam 115. The nonslip surfaces 215 are separated from the center beam 115, and therefore, the beam clamp 201 can freely slide along the center beam.

Figure 10:
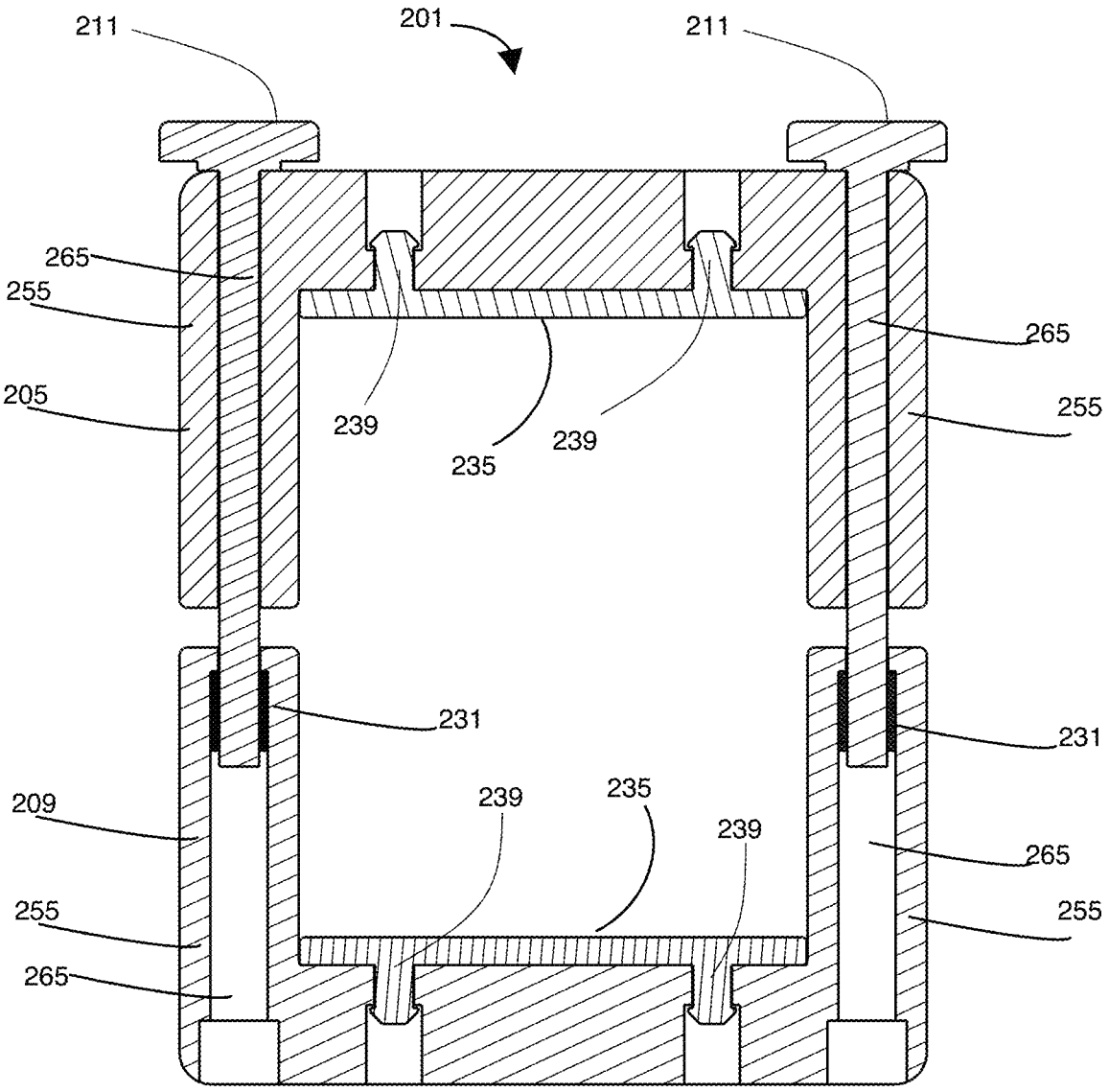
FIG. 10 shows a cutaway view of a longitudinal section of a beam clamp according to one embodiment.

FIG. 10 shows a side, cross-sectional view of a beam clamp 201, according to one embodiment. This view shows fasteners 211 penetrating down channels 267 positioned in sides 255 of the top 205 and bottom 209 piece. The fasteners 211 secured to securing members 231 disposed in the channels 267 of the bottom piece. In addition, this view shows pads 235 clipped onto interior surfaces of the top 205 and bottom 209 pieces by prong fasteners 239.

Figure 11:
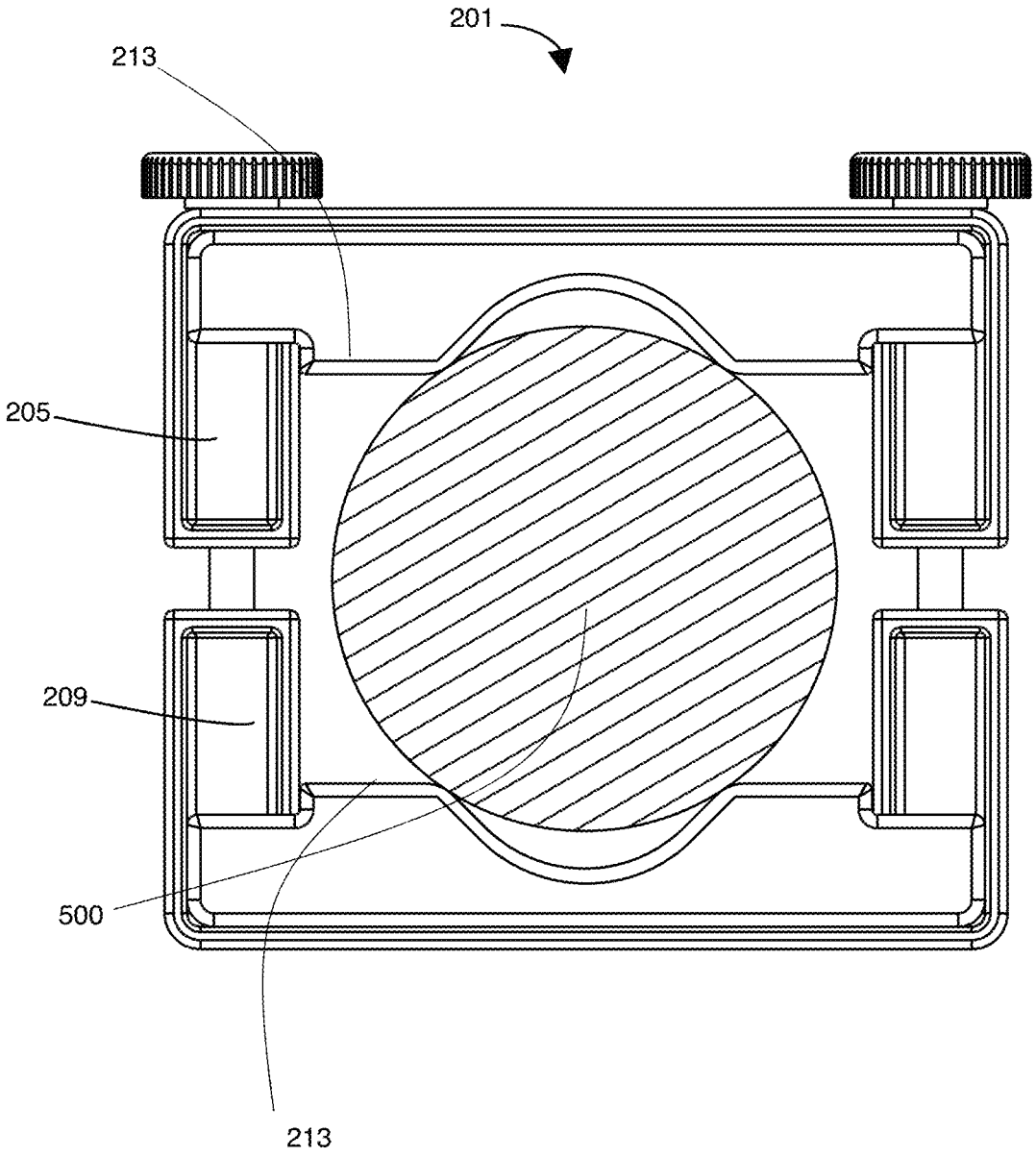
FIG. 11 shows a side view of an alternative embodiment for a beam clamp fastened to a circular center beams.
Figure 12:
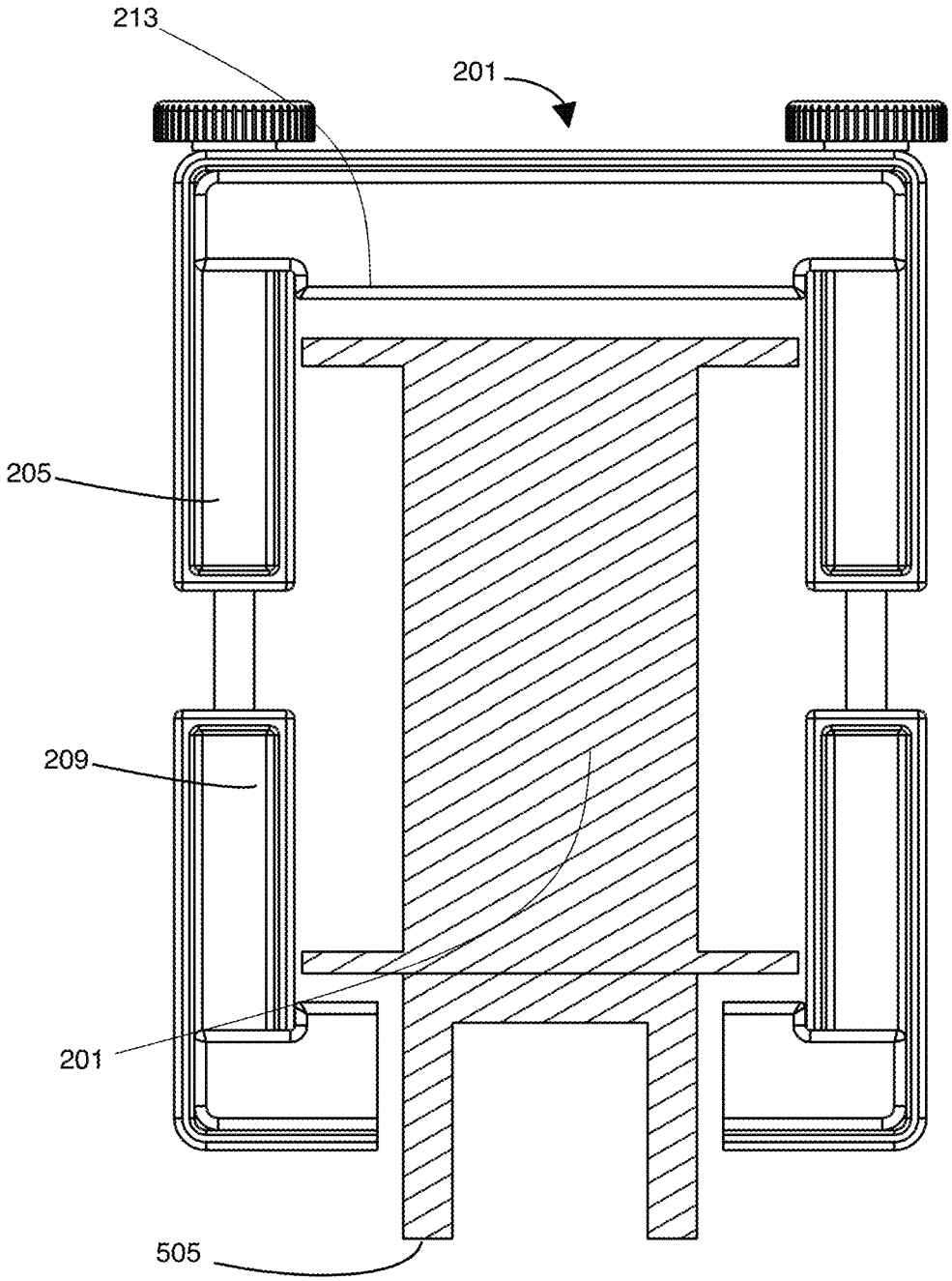
FIG. 12 shows a side view of an alternative embodiment for a beam clamp fastened to a center beam having an extension.

FIGS. 11 & 12 show side cutaway views of alternative embodiments for beam clamps 201. FIG. 11 shows an embodiment of a beam clamp adapted for a circular center beam 500. Interior surfaces 213 of a top 205 and bottom 209 piece comprise inwardly curved portions to accommodate the circular center beam 500. FIG. 12 shows an embodiment for a beam clamp that has been adapted for a center beam 201 that includes a lower extension 505. In this embodiment a portion of the bottom piece 209 is removed so that the beam clamp 201 can fit around the lower extension 505.

It should be understood that the above descriptions for beam clamps 201 are merely exemplary and in no way limit the potential embodiments. Further embodiments might include, for example, a clamp that attaches to the rower beam in a C shape, encompassing only a portion of a center beam as opposed to fastening around the entire circumference of the center beam. Alternatively, a beam clamp may comprise a boot-style clamp having open ends for lapping a lapping end over a lapped end in a lapping direction. The boot-style clamp tightening by clipping into itself in a boot-strap fashion.

In other embodiments of the invention, the systems and devices comprise a rowing machine and a chain clamp, the chain clamp reversibly attachable to a drive chain of the rower. Preferably, the chain clamp is used in conjunction with a beam clamp, described above; however, no system of the present invention is limited to an embodiment in which any one clamp is used in addition with another clamp.

Figure 13:
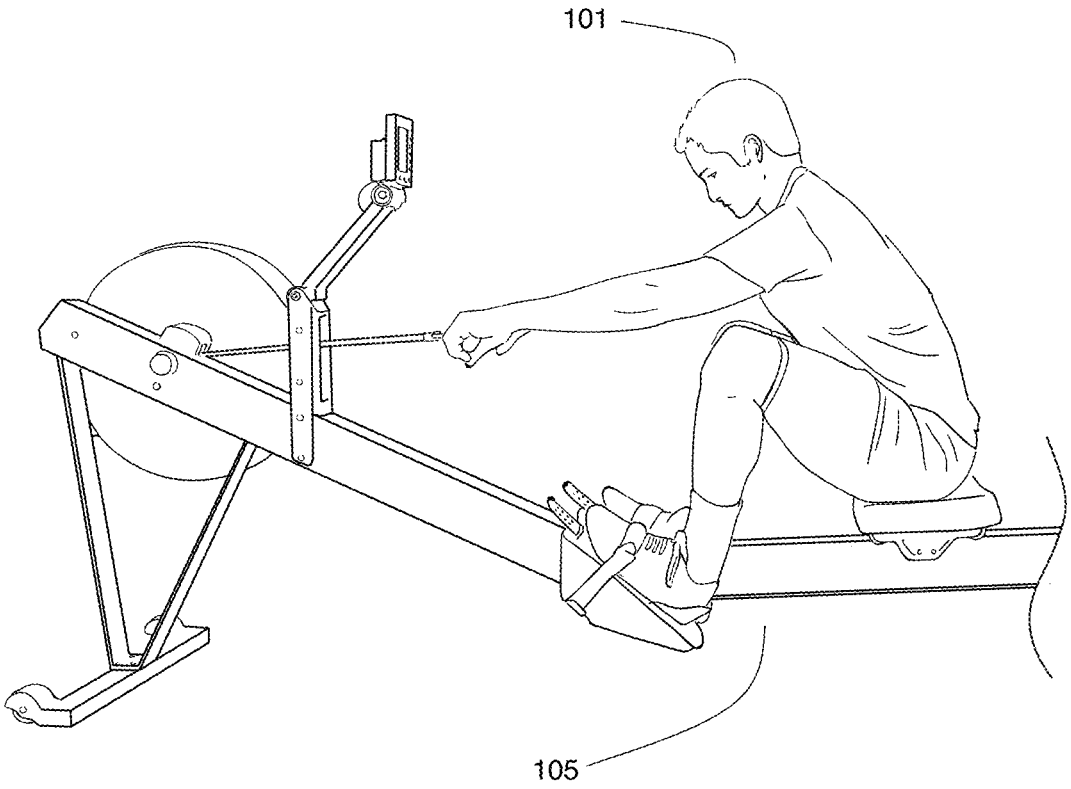
FIG. 13 illustrates a rower demonstrating poor catch form by leaning too far forwards.

FIG. 13 illustrates a rower 101 using a rowing machine 105 with poor catch technique. The technique is poor because the rower 101 is reaching too far forward, exhibiting poor posture. Reaching too far forward in the catch is undesirable at least because it impairs the rower's timing, weakens the rower's stroke, and strains the rower's back and shoulders. The chain clamp, according to some embodiments of the invention, corrects the rower's 101 posture by shortening the rower's 101 reach.

Figure 14:
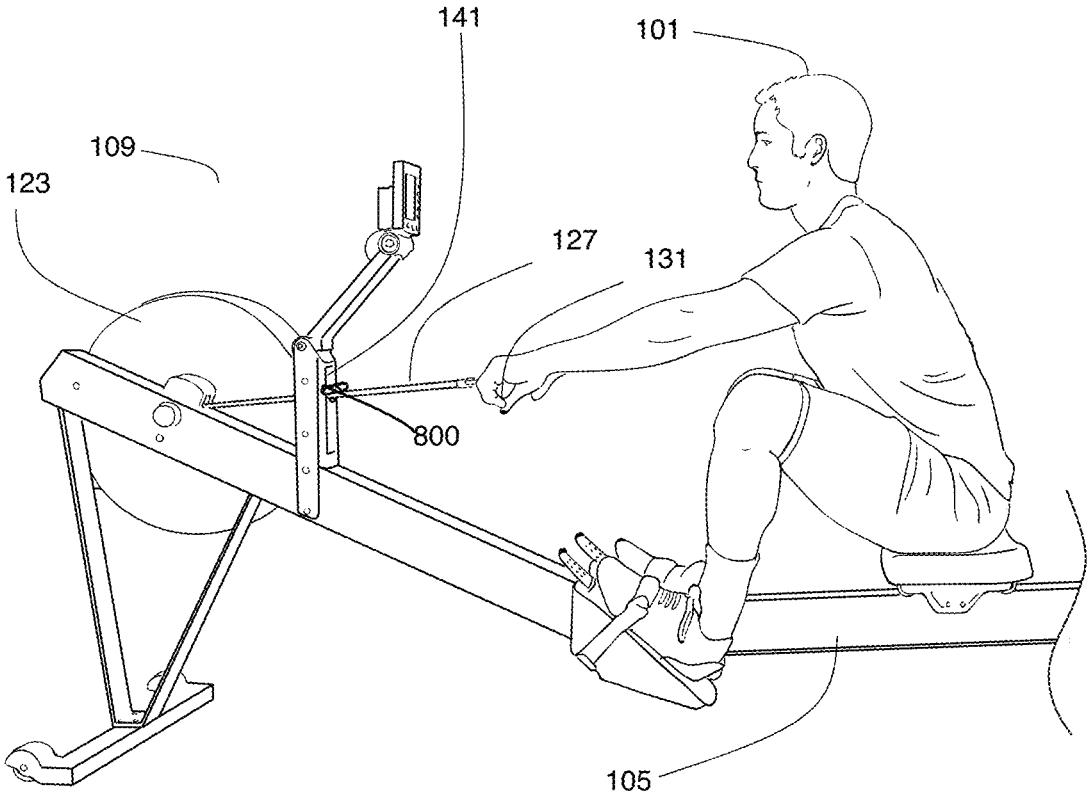
FIG. 14 illustrates rowing machine with a chain clamp attached to a drive chain to assisting a rower to execute proper catch form.

FIG. 14 illustrates a rower 101 using a rowing machine 105. The rowing machine includes a chain clamp 800, according to one embodiment of the invention, providing the rower proper posture. The chain clamp 800 is fastened to a drive chain 127 of the rowing machine. The chain clamp 800 corrects the rower's posture by shortening the rower's 101 reach. By shortening the rower's 101 reach, the handle 131 of the drive chain 127 stays closer to the rower 101 and the rower maintains a more upright position at the beginning and end of each stroke.

A chain clamp 800 shortens a rower's 101 reach by operating as a stopper when a drive chain is fed back into a resistance device 123 as the rower 101 leans forward to begin a new stroke. Generally, the rower 101 leans forward on a rowing machine 105, the resistance device 123 pulls the drive chain 127 back towards the device 123. When the drive chain 127 is pulled, the drive chain 127 passes through an aperture 141 wide enough for the drive chain 127 to pass through but too narrow for the chain clamp 800 to pass. By positioning the chain clamp 800 on a side of the aperture 141 with the rower 101 and opposite the resistance device 123, the chain clamp 800 stops the movement of the drive chain 127 into the resistance device 123 as the rower 101 leans forward. The association of the chain clamp 800 and aperture 141 provide indicate to a rower 101 how far the rower 101 should be lean in towards a front portion of the rowing machine at the catch.

Figure 15:
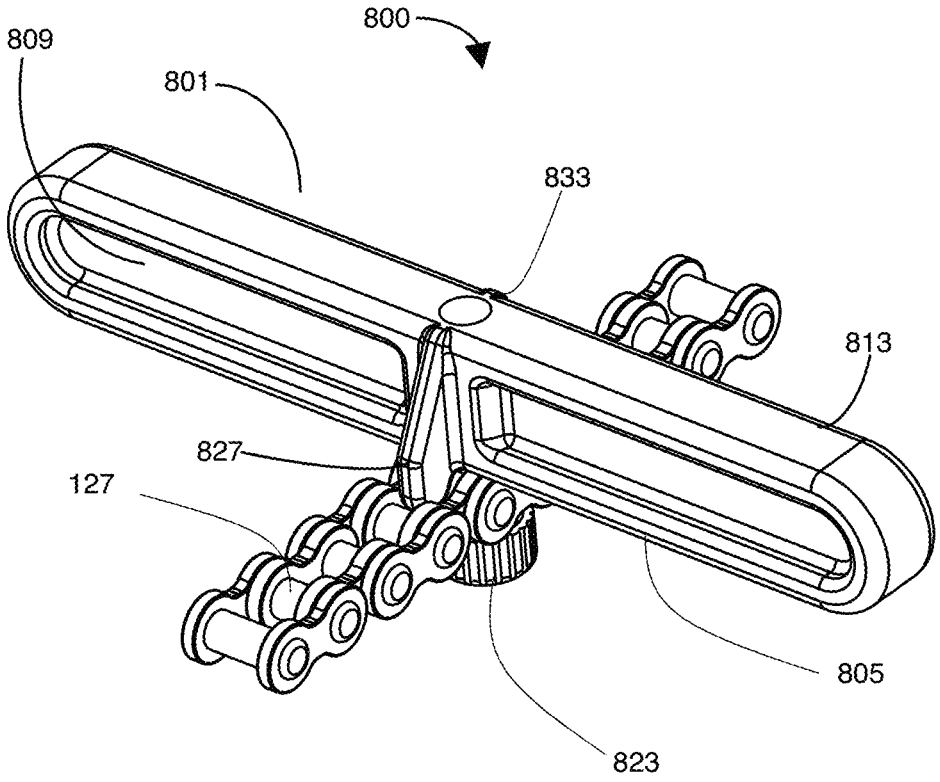
FIG. 15 shows a 3D view of a chain clamp according to one embodiment.

FIG. 15 shows a chain clamp 800 according to one embodiment of the invention. The chain clamp 800 comprises a generally rectangular body member 801 with a top 805, a first and second side 809, 813 and a bottom 817. The top 805 oriented downward and in contact with a drive chain 127. A fastener member 823 depicted opposite to the chain clamp 800 secures the chain clamp 800 to the drive chain 127. The first and second side 809, 813 comprise a first and second fin 827, 833 having a curved top surface configured to meet with curved surfaces of the drive chain 127.

Figure 16:
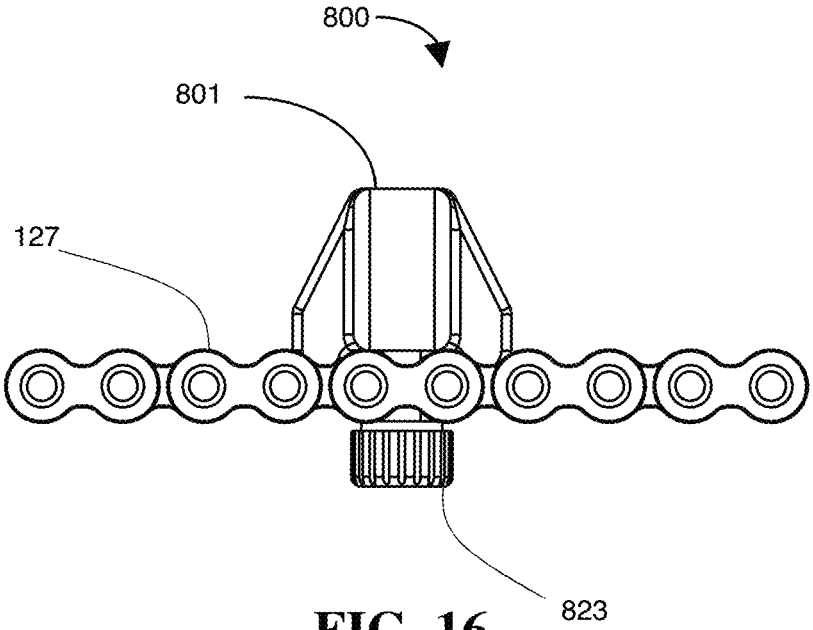
FIG. 16 is a side view of a chain clamp according to one embodiment.

FIG. 16 shows a side view of a chain clamp 800 attached onto a drive chain 127 according to one embodiment. This view shows the chain clamp 800 fitting onto the drive chain 127, wherein curved surfaces of the chain clamp 800 fit into groves of the drive chain 127 to prevent movement of the chain clamp 800 once the chain clamp 800 has been fastened to the drive chain 127.

Figure 17:
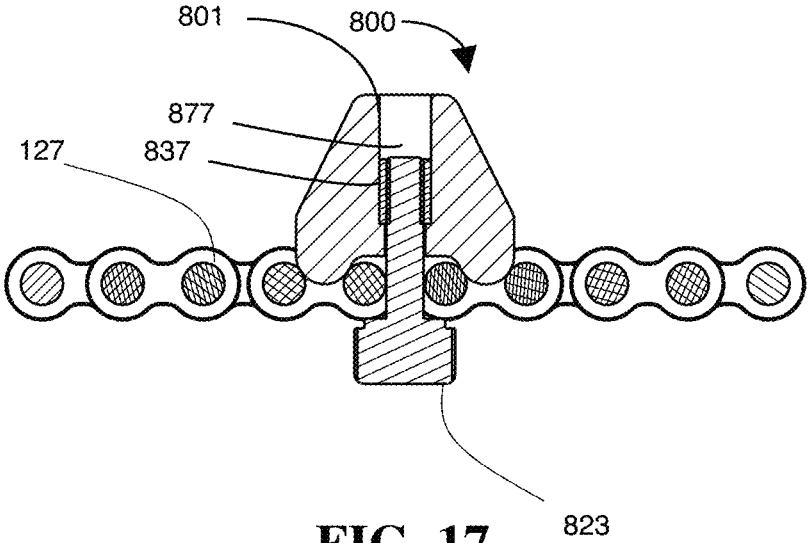
FIG. 17 is a cross sectional side view of a chain clamp according to one embodiment.

FIG. 17 shows a cross-sectional side view of a chain clamp 800. This view shows the fastener member 823 inserted through a link in the drive chain 127 and secured by a securing member 837, such as a nut, positioned within a recess 877 of the body member 801 of the chain clamp 800. This arrangement provides a mechanism for tightening the chain clamp 800 onto the drive chain 127.

Figure 18:
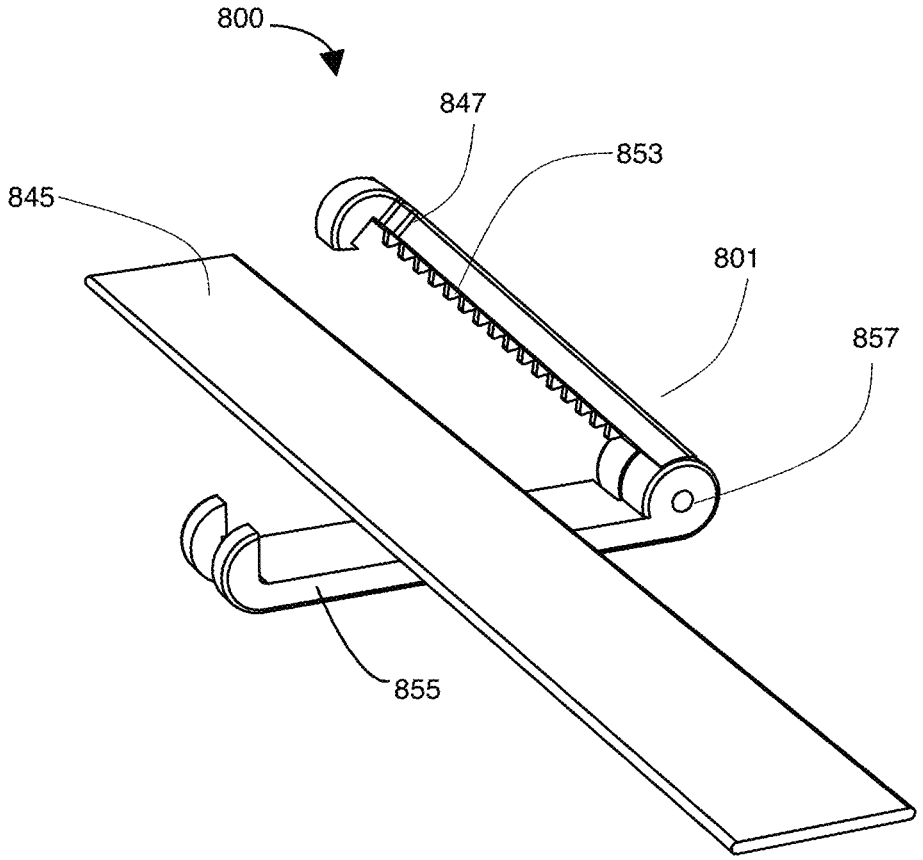
FIG. 18 shows an embodiment of a chain clamp.
Figure 19:
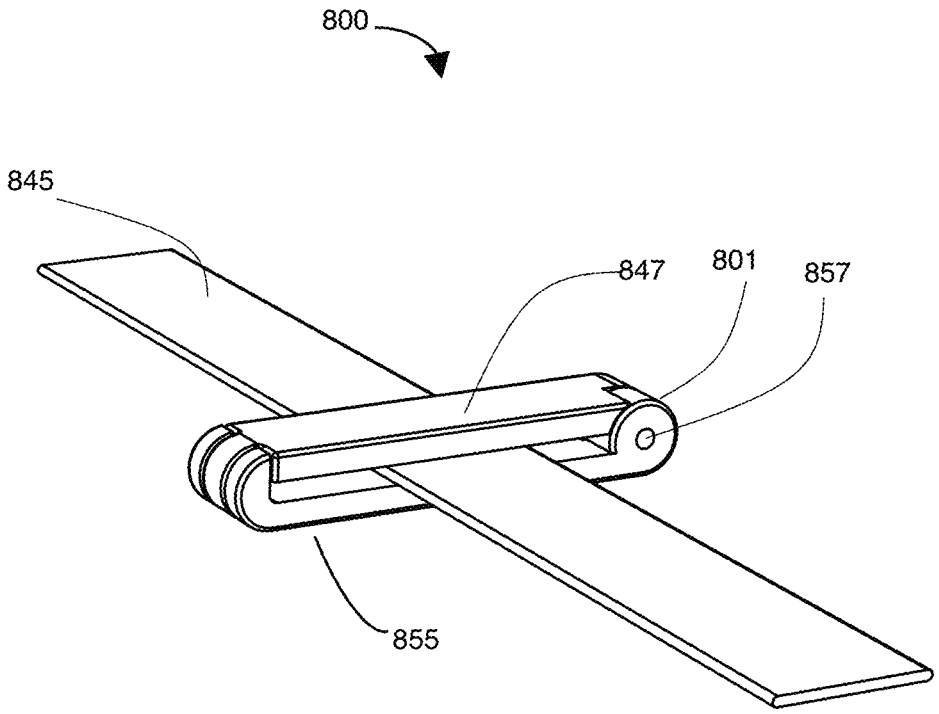

FIGS. 18 & 19 depict an alternate embodiment of a chain clamp 800 configured for attachment to a strap 845. A chain clamp 800 according to this embodiment comprises a rectangular body 877 with a top piece 847 attached to a bottom piece 855 by a hinge on 857 on one side of a rectangular body 801. The hinge 857 enables the chain clamp 800 to open and close onto a location of the strap 845. The top 847 can in some instances comprise a plurality of teeth 853, such that when the chain clamp 800 is closed onto the strap 845, the plurality of teeth depress into the strap 845 preventing the chain clamp 800 from moving along the strap 845.

FIGS. 20 & 21 depict an embodiment of a chain clamp 800 configured to attach to a strap 845 by weaving the strap 845 onto a center rail 891 interposed between two outer rails 893. Gaps 895 on the outer rails 893 allow a rower to slide the chain clamp 800 onto the strap 845 such that the strap 845 extends underneath the outer rails 893 and overtop the center rail 891.

In other embodiments of the invention, a system comprises a rowing machine an "L" shaped back support clamp, or L-clamp, attached to a rear portion of the seat. The L-clamp provides a reference point that a rower can use to know when and how far he or she should lean in during at the beginning of a stroke. In some systems of the invention the L-clamp is used in conjunction with the one or more other clamps described herein. However, the system comprising a rowing machine and L-shaped clamp is not necessarily limited to an embodiment in which the L-shaped clamp is used in addition to another clamp.

Figure 22:
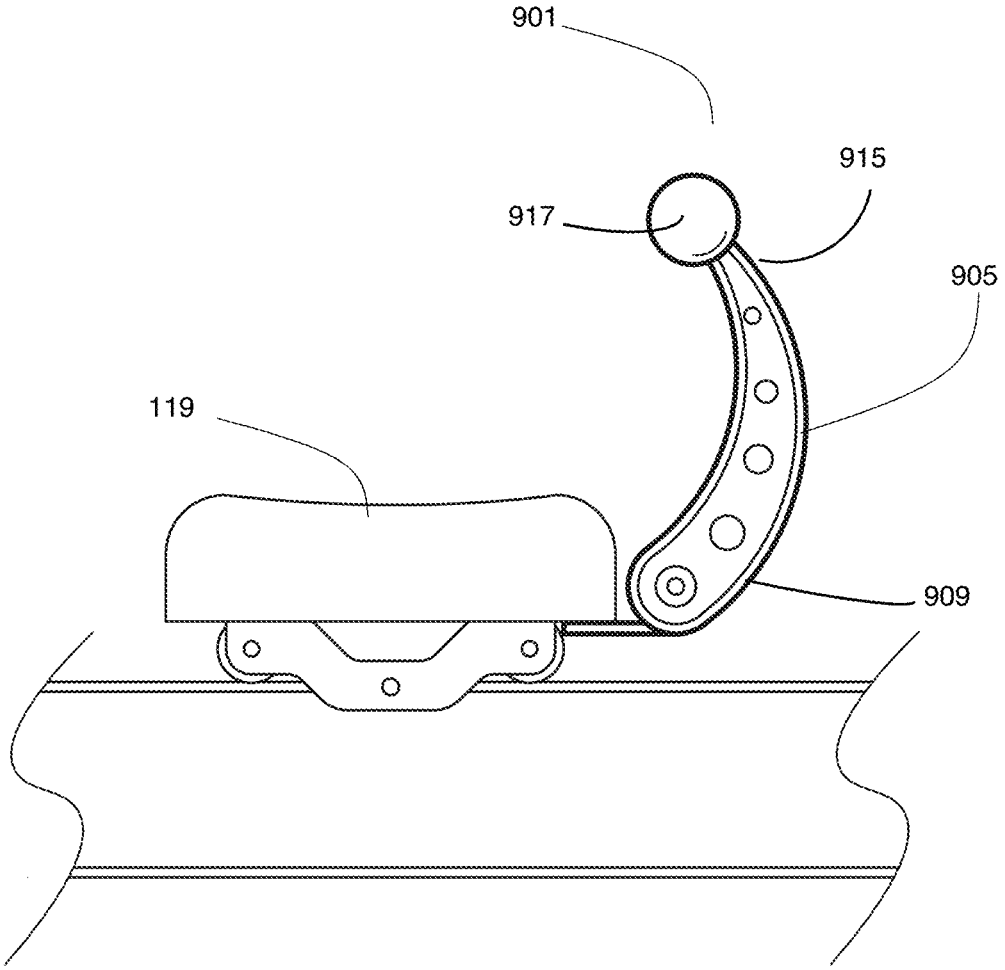
FIG. 22 illustrates an L-shaped clamp according to one embodiment.

FIG. 22 shows a side view of an L-clamp 901, according to one embodiment of the invention. The L-clamp shown is attached to a seat 119 of a rowing machine, the rowing machine cutaway. The L-clamp 901 can be attached to a rear portion of the seat 119 by a variety of different methods, such as, for example, clips, Velcro, or magnets. The L-clamp 901 can be crescent shaped with a generally curved, elongated body 905, having a first end 909 connected to a rear portion of the seat 119, and a second end 915 comprising a contact indicator 917. When a rower makes contact with the contact indicator 917 while the rower is in the catch position, it queues the rower to correct their posture.

Figure 23:
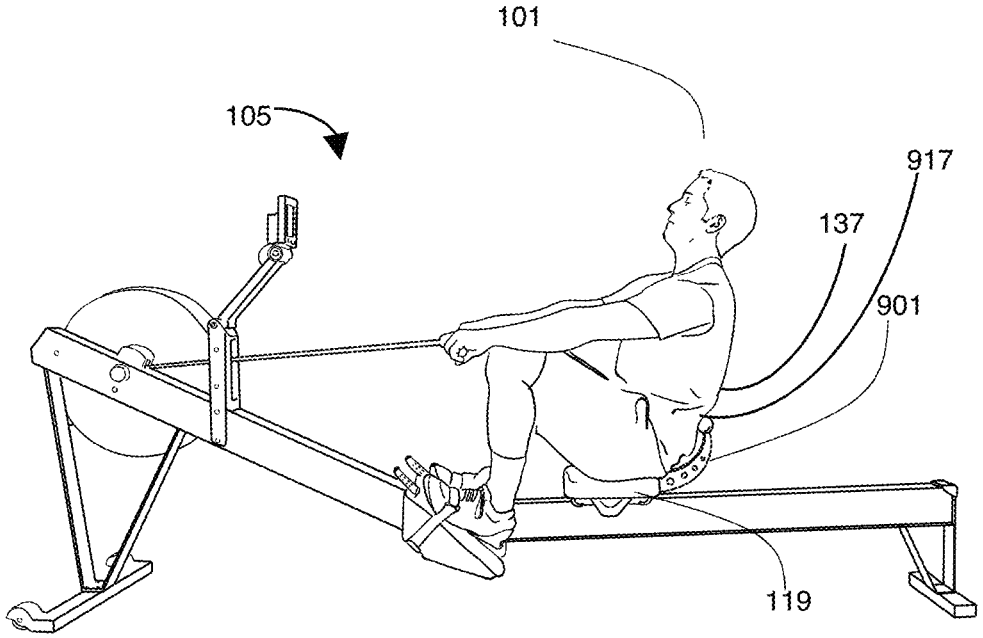
FIG. 23 illustrates a rower using a rowing machine with an L-shaped clamp according to one embodiment.
Figure 24:
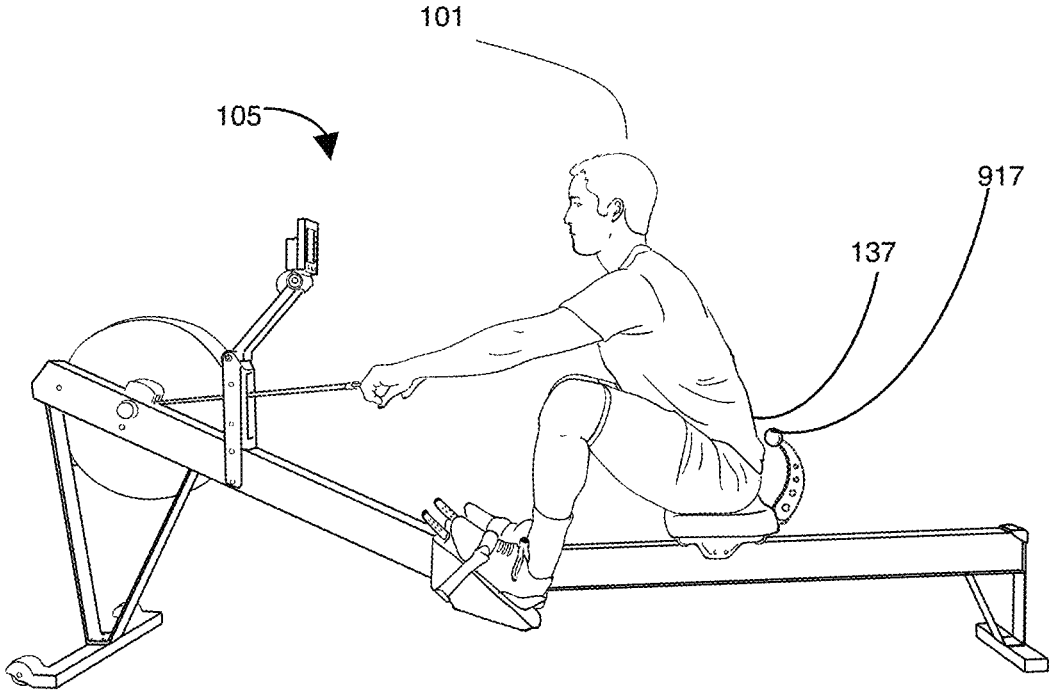
FIG. 24 illustrates a rower using a rowing machine with an L-shaped clamp according to one embodiment.

FIG. 23 illustrates a rower 101 using a rowing machine 105 with an L-clamp 901. The L-clamp 901 is fastened to a rear portion of a seat 119. As illustrated in FIG. 23, when the rower 101 leans too far back in the catch position, the rower's lower back 137 contacts the contact indicator 137 disposed at a second end 915 of the L-clamp. This contact prompts the rower 101 to lean forward, shown in FIG. 24.

The L-clamp 901 can be manufactured from a variety of materials including but not necessarily limited to plastics, metals or alloys, or any other suitable materials. The L-clamp can be formed by an injection mold, or similar process.

Various modifications and further embodiments are possible, beyond what is shown and described herein. This description contains information, exemplification, and guidance that can be adapted to create various other embodiments, all of which are to be considered included herein.

What is claimed is:

1. A system comprising:

a rowing machine comprising:

a frame with a front portion separated from a rear portion by a beam, a seat movable in a longitudinal direction along the beam relative to the frame, a resistance device associated with the frame, and a drive chain with a first end connected to the resistance device and a second end comprising a handle, whereby the handle is configured to be pulled by a user for resistance; and a beam clamp detachably disposed on the beam and arranged between the front portion and the seat, the beam clamp preventing the seat from moving beyond a specified distance towards the front portion, the beam clamp configured to position a rear of the user behind shoulders of the user relative to the front portion of the rowing machine when the user is in a catch position of a rowing movement using the rowing machine.

2. The system of claim 1 wherein the beam clamp further comprises:

a body formed by a top piece, a bottom piece, and at least one fastener for securing the top piece to the bottom piece; and an interior surface.

3. The system of claim 2 wherein the interior surface of the beam clamp is configured to embrace a circumference of the beam.

4. The system of claim 2 wherein the at least one fastener is a screw.

5. The system of claim 2 wherein at least a portion of the interior surface comprises a nonslip material to prevent the beam clamp from sliding during use.

6. The system of claim 2 wherein the interior surface of the beam clamp comprises inwardly curved portions for embracing a circular beam.

7. The system of claim 2 wherein the beam clamp embraces only a portion of the beam.

8. The system of claim 2 further comprising a chain clamp disposed on the drive chain and arranged between the resistance device and the handle, thereby preventing a portion of the drive chain comprising the handle from passing through an aperture associated with the frame.

9. The system of claim 8 wherein the chain clamp comprises:

a rectangular body comprising a top having an opening for receiving a fastener member; and a first side and a second side, each of the first and second sides comprising fins disposed substantially near a center of each respective side and generally perpendicular to the rectangular body, each of the fins having a curved top surface configured to respectively associate with grooves on the drive chain.

10. The system of claim 9 wherein the chain clamp is secured to the drive chain in part by inserting the fastener member through a link in the drive chain.

11. The system of claim 8 wherein placement of the chain clamp is configured to be selected based on a range of motion of the user.

12. The system of claim 8 wherein the chain clamp is configured to attach to a strap.

13. The system of claim 2 further comprising an L-clamp comprising:

a generally curved, elongated body;

a first end connected to a rear portion of the seat; and a second end comprising a contact indicator, wherein the contact indicator is configured to provide the user with information relating to a position of a back of the user.

14. The system of claim 13 wherein the contact indicator is configured to cue the user to lean forward when the back of the user contacts the contact indicator.

15. The system of claim 14, wherein the L-clamp is crescent shaped.

* * * * *